US007141749B1

(12) United States Patent
Lin

(10) Patent No.: US 7,141,749 B1
(45) Date of Patent: Nov. 28, 2006

(54) SOCKET SWITCH FOR LIGHT BULB

(76) Inventor: Shan Chaing Lin, No. 2, Lane 111, Ta Chu Road, Lu Chu Hsiang, Taoyuan Hsien (TW)

( * ) Notice: Subject to any disclaimer, the term of this patent is extended or adjusted under 35 U.S.C. 154(b) by 0 days.

(21) Appl. No.: 11/346,260

(22) Filed: Feb. 3, 2006

(51) Int. Cl.
*H01H 13/00* (2006.01)
*H01H 3/00* (2006.01)

(52) U.S. Cl. ..... 200/339; 200/553; 315/362

(58) Field of Classification Search ..... 200/339, 200/553–559, 405, 537; 315/360–363, 247, 315/291, 307, 314
See application file for complete search history.

(56) References Cited

U.S. PATENT DOCUMENTS 4,842,556 A * 6/1989 Vogel ..... 439/638
6,005,210 A * 12/1999 Chien ..... 200/438
6,201,201 B1 * 3/2001 Wu ..... 200/405
6,242,706 B1 * 6/2001 Miyata ..... 200/537
6,479,776 B1 * 11/2002 Nakase et al. ..... 200/559
6,501,237 B1 * 12/2002 Davies ..... 315/362
6,880,444 B1 * 4/2005 Ang ..... 89/14.4

* cited by examiner

*Primary Examiner*—K. Lee
(74) *Attorney, Agent, or Firm*—Troxell Law Office, PLLC

(57) ABSTRACT

A socket switch for a light bulb comprises a shell, a main body, a grounding unit, a switch unit, an electric conduction unit, wherein a holding chamber is formed inside the shell. The shell has two coupling holes formed thereon. The grounding unit, the switch unit, and the electric conduction unit are connected a surface of the main body, and this surface of the main body is screwed onto the shell via the coupling holes and located inside the holding chamber. The switch unit is designed for electrically connecting an electrode of a power supply, which is connected to the electric conduction unit, with an electrode of the light bulb for lighting up this light bulb. As a result, the purpose of saving energy can be achieved by controlling electric conduction between the power supply and the light bulb.

3 Claims, 7 Drawing Sheets

SOCKET SWITCH FOR LIGHT BULB

FIELD OF THE INVENTION

The present invention relates to a socket switch for a light bulb, and more particularly to a socket switch that achieves the purpose of saving energy by controlling electric conduction between a power supply and the light bulb.

BACKGROUND OF THE INVENTION

The socket for a light bulb is designed for electric conduction between the light bulb and an electric wire of a power supply, wherein the electric conduction between several light bulbs and several sockets are controlled by a power switch. All of the light bulbs are lighted up simultaneously even if only one or some of the light bulbs need to be light up for putting emphatic lighting on key exhibitions. As a result, it is troublesome for the user to adjust the lighting status of one or some of the light bulbs instantaneously.

The conventional socket has the following drawbacks, wherein: 1. the socket cannot save energy and protect environment since it cannot switch on or off some of the light bulbs in accordance with the need of the user; and 2. the attention of the user is dispersed and the purpose of putting emphatic lighting on key exhibitions cannot be achieved since these light bulbs are lighted up simultaneously.

SUMMARY OF THE INVENTION

A main object of the present invention is to provide a socket switch for a light bulb by which the number of the lighted light bulbs can be controlled and the purpose of saving energy and protecting environment can be also achieved. The socket switch comprises a shell, a main body, a grounding unit, a switch unit, an electric conduction unit, wherein a holding chamber is formed inside the shell. The shell has two coupling holes formed thereon. The grounding unit, the switch unit, and the electric conduction unit are connected a surface of the main body, and this surface of the main body is screwed onto the shell via the coupling holes and located inside the holding chamber. The switch unit is designed for electrically connecting an electrode of a power supply, which is connected to the electric conduction unit, with an electrode of the light bulb for lighting up this light bulb. As a result, the purpose of saving energy can be achieved by controlling electric conduction between the power supply and the light bulb.

By means of the above-mentioned structure, the present invention can improve the conventional drawbacks and can provide the following advantages, wherein: 1. the socket switch for the light bulb can light up some of the light bulbs in accordance with the need of the user; and 2. the purpose of putting emphatic lighting on key exhibitions can be achieved for increasing the chance of trade.

DETAILED DESCRIPTION OF THE PREFERRED EMBODIMENT

Figure 1:
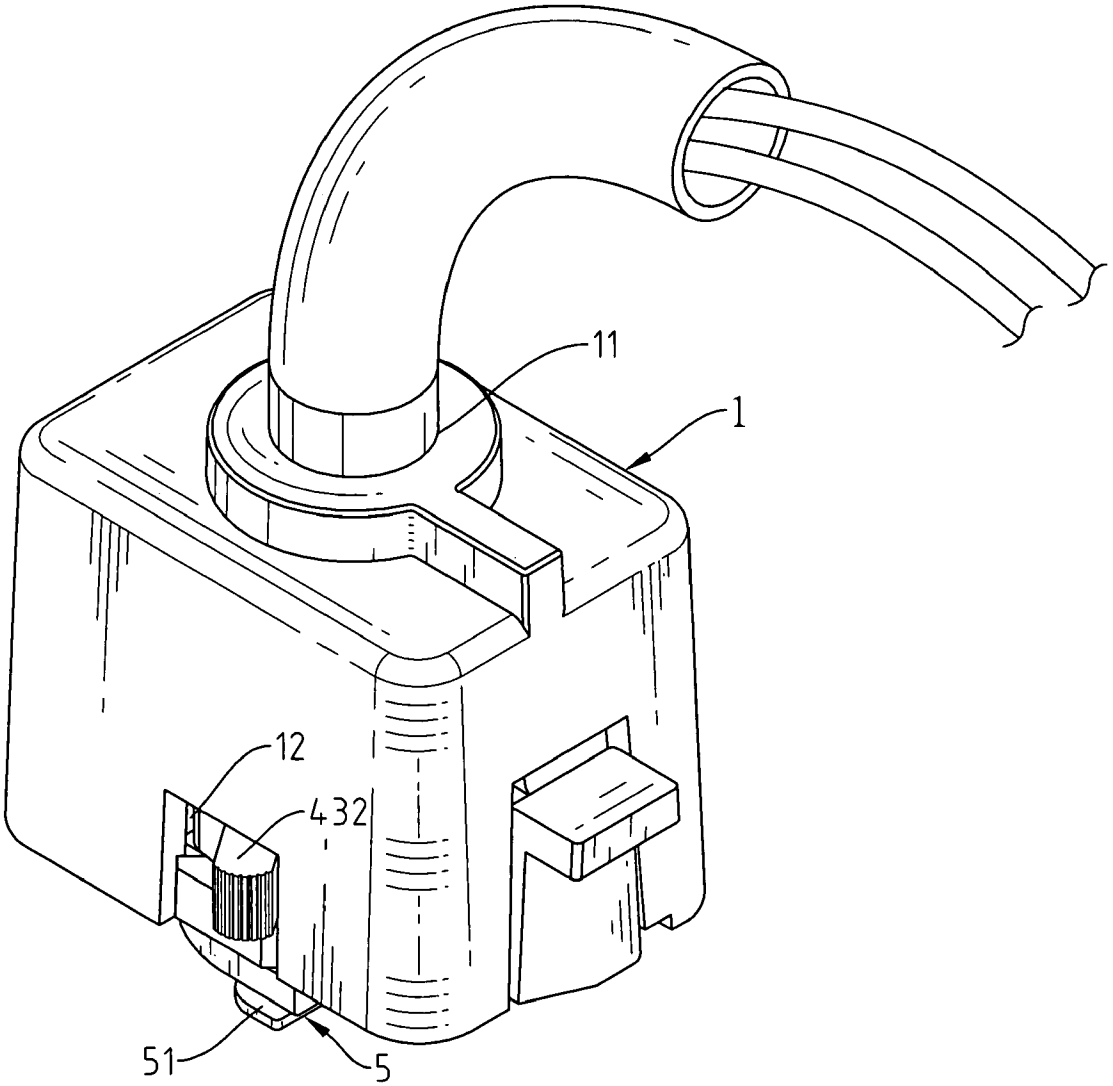
FIG. 1 is a three-dimensional view showing the assembled socket switch and electric wire of the present invention.
Figure 2:
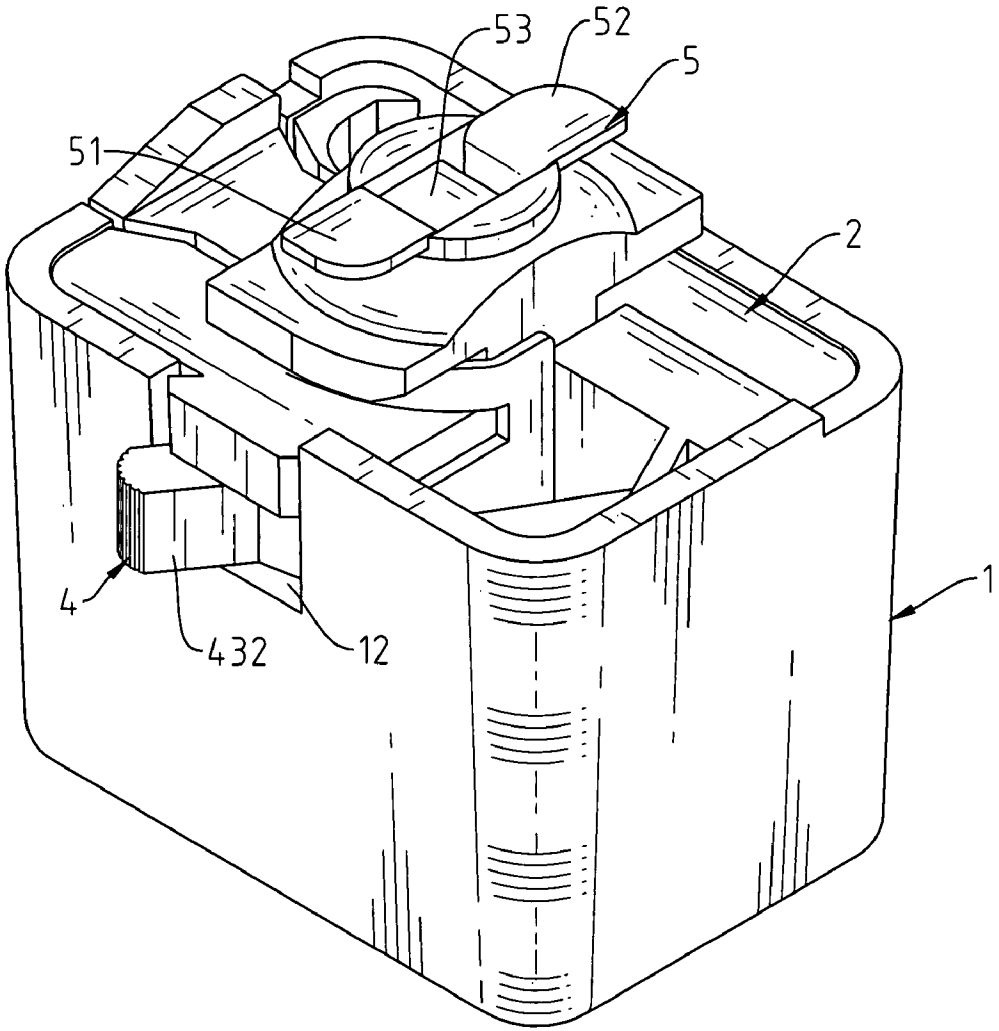
FIG. 2 is a three-dimensional, bottom view of the socket switch of the present invention.
Figure 3:
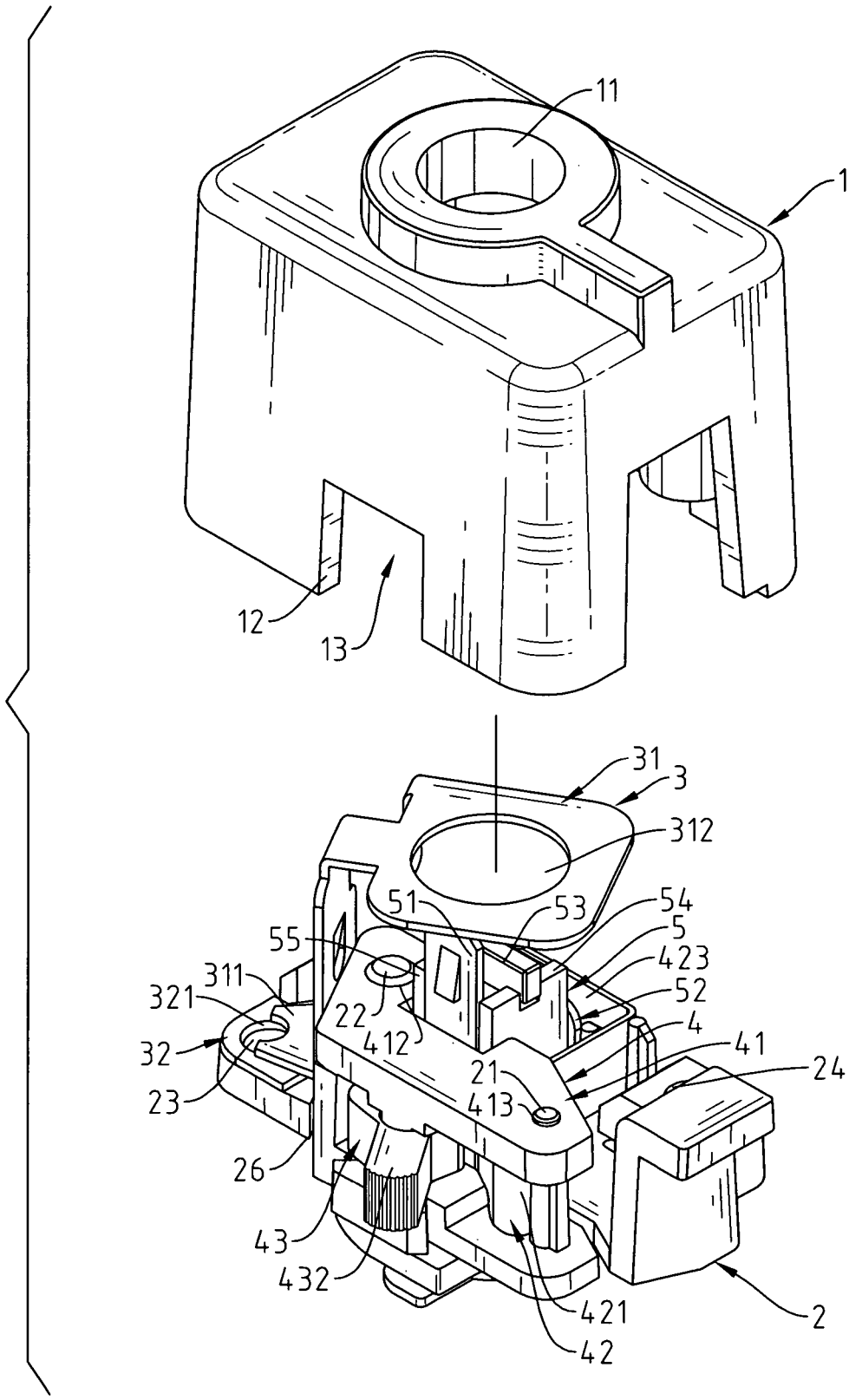
FIG. 3 is a three-dimensional view showing the assembled inside components of the socket switch of the present invention.

Referring to FIG. 1 through FIG. 3, a preferred embodiment of the present invention is shown. A socket switch for a light bulb comprises a shell 1, a main body 2, a grounding unit 3, a switch unit 4, an electric conduction unit 5, wherein a through hole 11 is formed on a front surface of the shell 1 and a holding notch 12 is formed on one side of the shell 1. Besides, a holding chamber 13 is formed inside the shell 1, and the through hole 11 is designed for being penetrated through by an electric wire or a conduit that connects with the light bulb. Two insertion bolts 21, 22, two coupling holes 23, 24, an insertion pivot 25, a notch 26, and a pivotal connection trench 27 are located on the main body 2. The grounding unit 3, the switch unit 4, and the electric conduction unit 5 are connected to a surface of the main body 2, and this surface of the main body 2 is screwed onto the shell 1 via the coupling holes 23, 24 and located inside the holding chamber 13.

Figure 4:
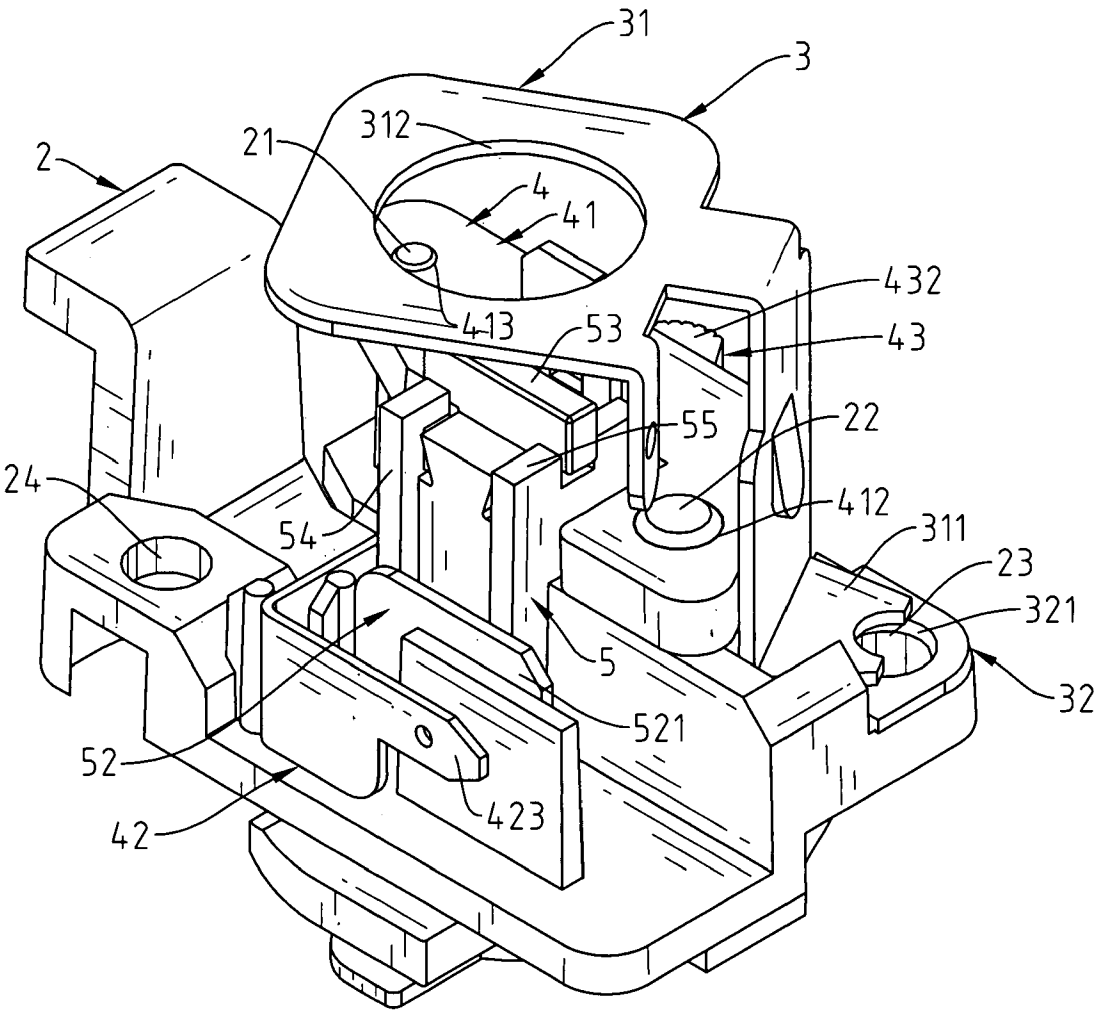
FIG. 4 is a three-dimensional view showing a main body of the socket switch of the present invention.
Figure 5:
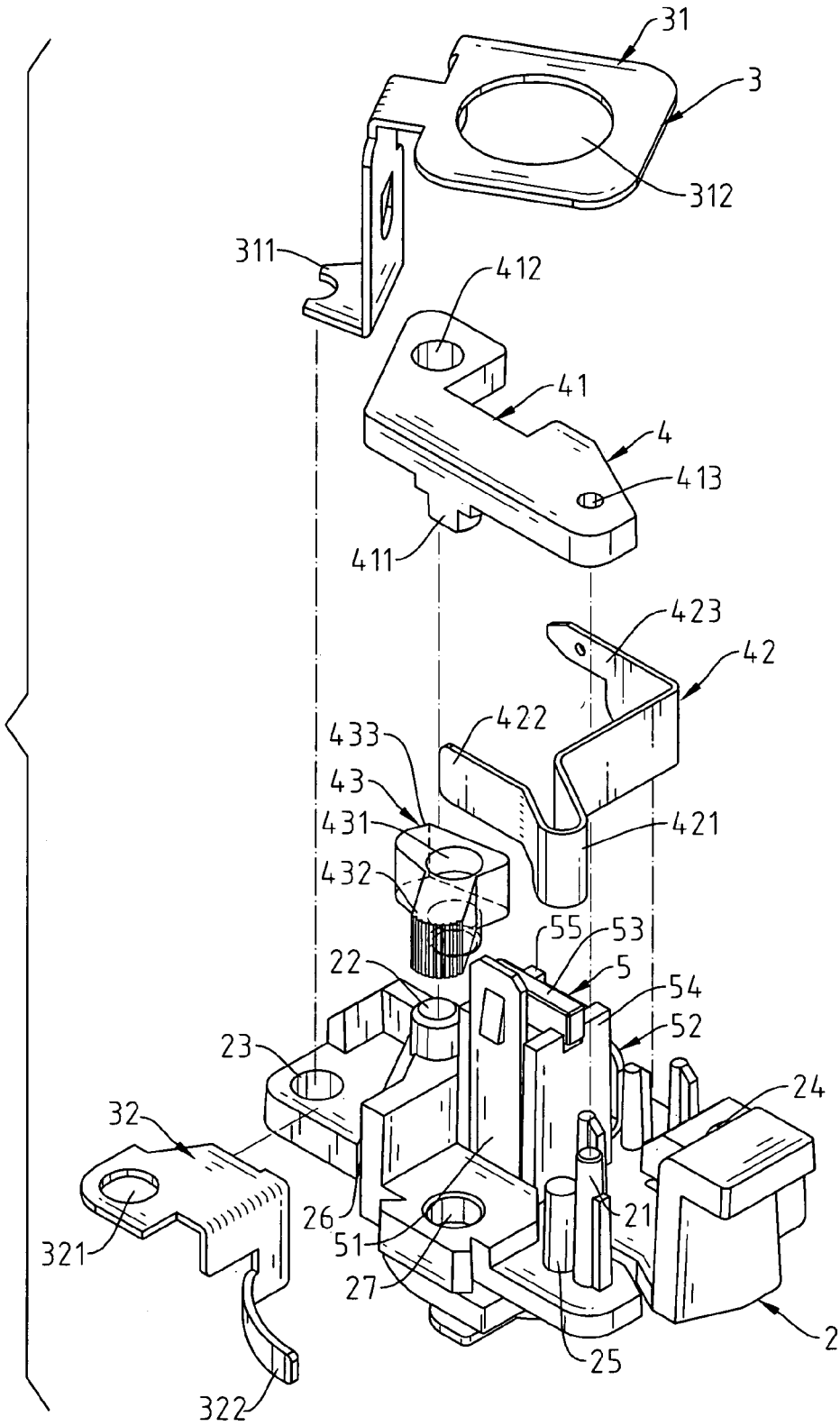
FIG. 5 is a three-dimensional view showing the assembled inside components of the main body of the present invention.

Referring to FIG. 3 through FIG. 5, the assembled structure of the above-mentioned components is shown. The grounding unit 3 comprises an elastic grounding sheet 31 and an elastic metal grounding sheet 32, wherein the elastic grounding sheet 31 has a contact part 311 and a through hole 312, and the elastic metal grounding sheet 32 has a coupling hole 321 and a grounding terminal 322. The center of the elastic metal grounding sheet 32 is bended and embedded into the notch 26 of the main body 2 so as to attach the elastic metal grounding sheet 32 to the main body 2. The coupling hole 321 of the elastic metal grounding sheet 32 is correspondingly located on the top of the coupling hole 23. The grounding terminal 322 is flatly attached to a position of the main body 2, which is grounded. The contact part 311 of the elastic grounding sheet 31 is mounted on one side of the notch 26 above the elastic metal grounding sheet 32. The through hole 312 is located on the inside of the shell 1 corresponding to the through hole 11.

The switch unit 4 comprises a coupling means 41, an elastic switch sheet 42, and a switch means 43, wherein the coupling means 41 has a pivotal connection part 411 and two insertion holes 412, 413. The elastic switch sheet 42 has a holding part 421, an elastic part 422, and a first electric conduction part 423. The switch means 43 has a pivotal connection trench 431, a rotation shaft 432, and a push part 433. The insertion bolts 21, 22 are fixedly inserted into the insertion holes 412, 413 of the coupling means 41. The pivotal connection part 411 is axially connected with the pivotal connection trench 431 of the switch means 43. A pivot, which is mounted on the bottom of the switch means 43, is pivotally connected to the pivotal connection trench 27. The rotation shaft 432 is mounted on one side of the switch means 43 and extended from the holding notch 12 of the shell 1. The push part 433 is mounted on the other side of the rotation shaft 432, and the elastic part 422 of the elastic switch sheet 42 is located on the other side of the push part 433. The holding part 421 is mounted on a central region of the elastic switch sheet 42, wherein the insertion pivot 25 is inserted into the holding part 421. The first electric conduction part 423, which is mounted on the other side of the elastic switch sheet 42, is connected to a positive electrode of the light bulb.

The electric conduction unit 5 comprises an elastic electrode-touching sheet 51, an elastic electrode sheet 52, an insulator 53, and two partitions 54, 55, wherein these two partitions 54, 55 are mounted on a central region of the main body 2 for forming a hollow chamber inside which the elastic electrode-touching sheet 51, the elastic electrode sheet 52, and the insulator 53 are mounted. The insulator 53 is mounted between the elastic electrode-touching sheet 51 and the elastic electrode sheet 52. The insulator 53 is designed for separating the elastic electrode-touching sheet 51 from the elastic electrode sheet 52. The bottom of the elastic electrode-touching sheet 51 is connected to a positive electrode of a power supply, and the bottom of the elastic electrode sheet 52 is connected to a negative electrode of the power supply. A second electric conduction part 521, which is mounted inside the elastic electrode sheet 52, is connected to a negative electrode of the light bulb, wherein the elastic electrode-touching sheet 51 is separated from the elastic electrode sheet 52. The elastic part 422 of the elastic switch sheet 42 is located on one side of the elastic electrode-touching sheet 51 and they are spaced at a certain distance from each other.

Figure 6:
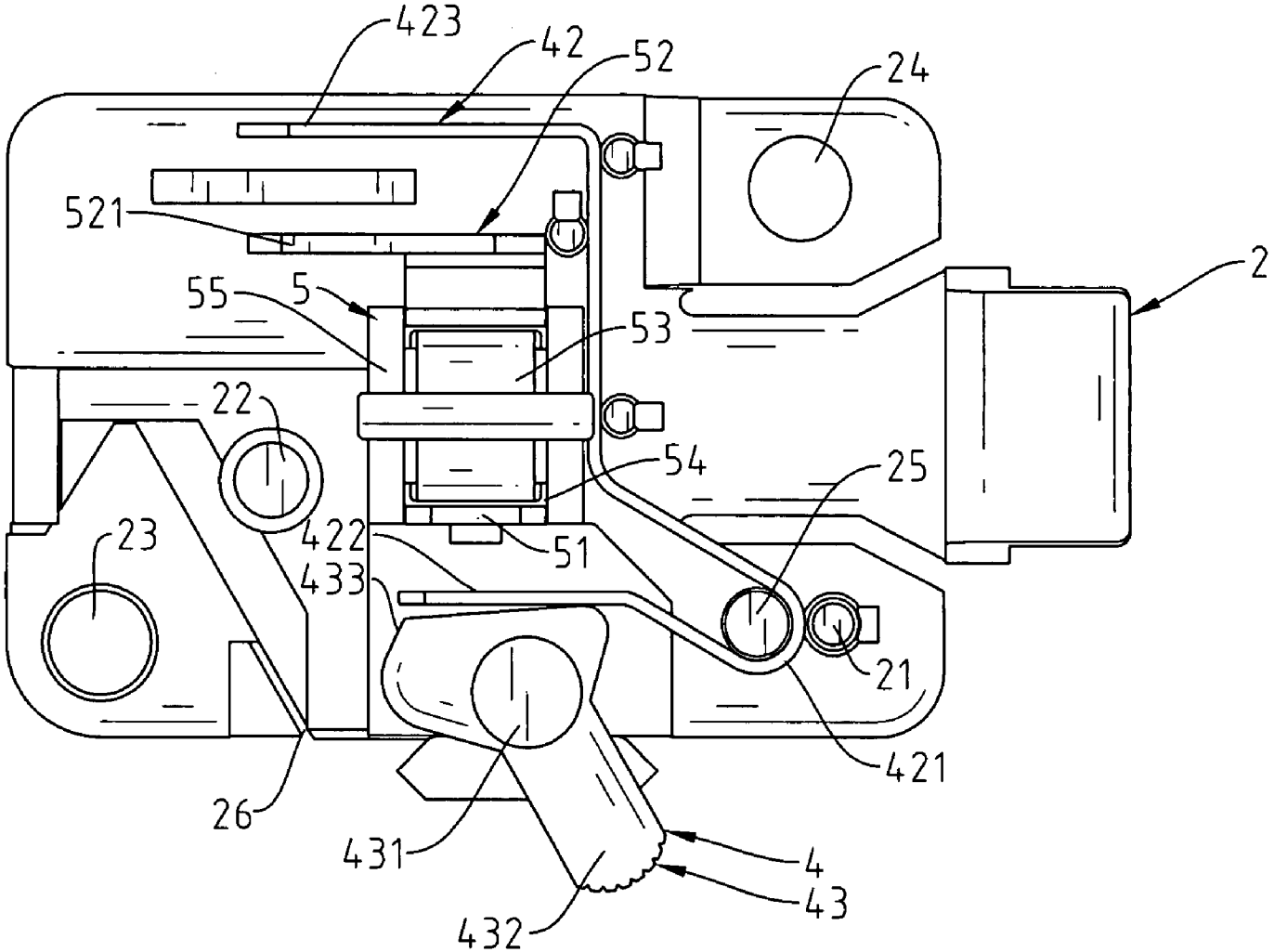
FIG. 6 is a schematic view showing the operation of the switch unit of the present invention.
Figure 7:
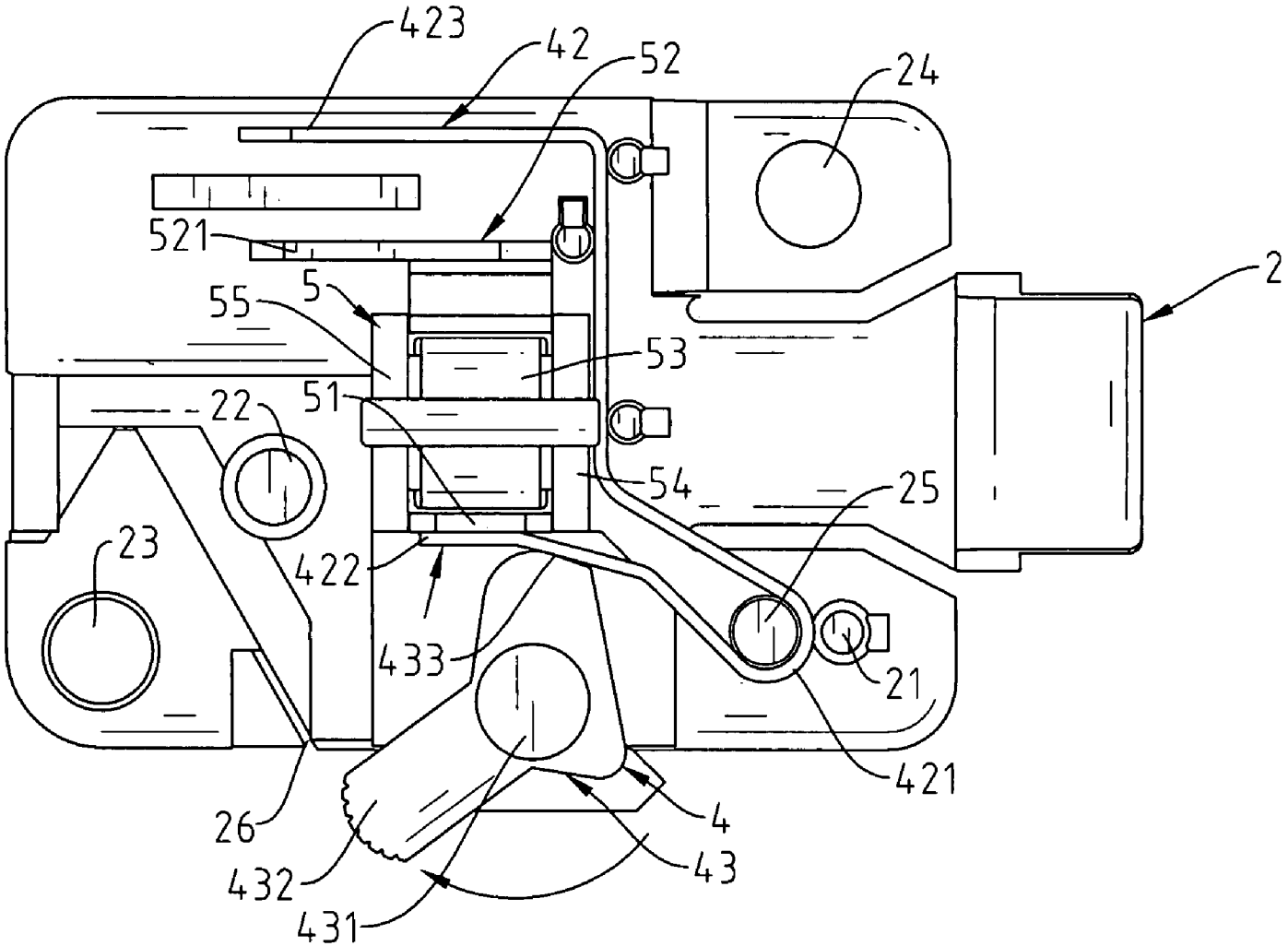
FIG. 7 is a schematic view showing the operation of the switch unit of the present invention.

FIG. 6 and FIG. 7 are schematic views showing the operation of the socket switch of the present invention. When in use, the rotation shaft 432 of the switch means 43 is rotated toward one direction so as to drive the push part 432, which is mounted on the other side of the rotation shaft 432, such that the push part 433 is rotated to lean against the elastic part 422 of the elastic switch sheet 42 for further enabling the elastic part 422 to touch the elastic electrode-touching sheet 51.

In the above-mentioned operation, the positive electrode of the power supply is electrically connected to the positive electrode of the light bulb by contacting the elastic switch sheet 42 with the elastic electrode-touching sheet 51, and the negative electrode of the power supply is electrically connected to the negative electrode of the light bulb via the elastic electrode sheet 52. As a result, the light bulb is lighted up.

If there is a need to switch off the light bulb, the rotation shaft 432 is pushed toward the other direction so as to separate the elastic part 422 from the elastic electrode-touching sheet 51.

What the invention claimed is:

1. A socket switch for a light bulb comprising:

a shell on which a through hole is formed for being penetrated through by an electric wire or a conduit that connects with the light bulb; and a main body screwed inside the shell, the main body comprising a grounding unit, a switch unit, an electric conduction unit, wherein the grounding unit comprises an elastic grounding sheet connected to the main body and an elastic metal grounding sheet flatly attached to a grounded position of the main body, the elastic grounding sheet being attached to the elastic metal grounding sheet and connected to the main body;

the switch unit comprises a coupling means, an elastic switch sheet, and a switch means, the coupling means being pivotally connected to the switch means and connected to the main body, the elastic switch sheet being mounted on the main body and comprising a first electric conduction part and an elastic part, the first electric conduction part being connected to a positive electrode of the light bulb, the switch means being pivotally mounted between the coupling means and the main body, the switch means having a rotation shaft extending from the shell, a push part being mounted inside the switch means corresponding to the elastic part of the elastic switch sheet; and the electric conduction unit comprises an elastic electrode-touching sheet, an elastic electrode sheet, an insulator, and two partitions, the bottom of the elastic electrode-touching sheet being connected to a positive electrode of a power supply, the bottom of the elastic electrode sheet being connected to a negative electrode of the power supply, a second electric conduction part being mounted inside the elastic electrode sheet and connected to a negative electrode of the light bulb, the elastic electrode-touching sheet and the elastic electrode sheet being separated from each other, the elastic switch sheet being located on one side of the elastic electrode-touching sheet in a predetermined distance from the elastic electrode-touching sheet, whereby if the elastic part of the elastic switch sheet is pushed to touch the elastic electrode-touching sheet by the push part mounted inside the switch means, the positive electrode of the light bulb, which is connected to the elastic switch sheet, is electrically connected to the positive electrode of the power supply, which is connected to the elastic electrode-touching sheet, and the negative electrode of the power supply is electrically connected to the negative electrode of the light bulb via the elastic electrode sheet for lighting up the light bulb.

2. The socket switch for the light bulb of claim 1, wherein the partitions are mounted on a central region of the main body for forming a hollow chamber for holding the elastic electrode-touching sheet, the elastic electrode sheet, and the insulator.

3. The socket switch for the light bulb of claim 1, wherein the insulator is mounted between the elastic electrode-touching sheet and the elastic electrode sheet for separating the elastic electrode-touching sheet from the elastic electrode sheet.

* * * * *